US009062504B2

(12) United States Patent
Lundberg et al.

(10) Patent No.: US 9,062,504 B2
(45) Date of Patent: Jun. 23, 2015

(54) ROCK DRILL BIT, A DRILLING ASSEMBLY AND A METHOD FOR PERCUSSIVE ROCK DRILLING

(75) Inventors: Christer Lundberg, Sandviken (SE); Rasmus Hemph, Sandviken (SE)

(73) Assignee: Sandvik Intellectual Property AB, Sandvicken (SE)

( * ) Notice: Subject to any disclaimer, the term of this patent is extended or adjusted under 35 U.S.C. 154(b) by 274 days.

(21) Appl. No.: 13/581,826

(22) PCT Filed: Feb. 16, 2011

(86) PCT No.: PCT/SE2011/050169

§ 371 (c)(1),
(2), (4) Date: Sep. 11, 2012

(87) PCT Pub. No.: WO2011/112137

PCT Pub. Date: Sep. 15, 2011

(65) Prior Publication Data

US 2012/0325558 A1 Dec. 27, 2012

(30) Foreign Application Priority Data

Mar. 9, 2010 (EP) ..... 10155920

(51) Int. Cl.
*E21B 10/38* (2006.01)
*E21B 1/00* (2006.01)
(Continued)

(52) U.S. Cl.
CPC .. *E21B 10/38* (2013.01); *E21B 4/14* (2013.01)

(58) Field of Classification Search
CPC ..... E21B 10/38; E21B 10/36; E21B 1/00; E21B 4/08; E21B 4/14
USPC ..... 175/57, 418, 420.1, 393
See application file for complete search history.

(56) References Cited

U.S. PATENT DOCUMENTS 2,807,443 A * 9/1957 Wyman ..... 175/404
3,185,228 A * 5/1965 Kelly, Jr. ..... 175/426
(Continued)

FOREIGN PATENT DOCUMENTS

SU 1073428 2/1984
WO WO 9015220 A1 * 12/1990 ..... E21B 10/38
(Continued)

OTHER PUBLICATIONS

International Search Report for PCT/SE2011/050169 dated Jun. 7, 2011.
(Continued)

*Primary Examiner* — Jennifer H Gay
(74) *Attorney, Agent, or Firm* — Morgan, Lewis & Bockius LLP

(57) ABSTRACT

A rock drill bit for percussive drilling comprising a bit head configured to be attached at an end of a drill element of a drilling assembly and having a diameter larger than that of a said drill element. The bit head has at a front end as seen in the intended drilling direction a generally frusto-conical shape defined by a substantially circumferential ring provided with a plurality of gauge buttons distributed along the extension of the ring for engaging material to be crushed. A central flush channel extends through the bit head and has at least one flushing hole opening at said front end to conduct flushing medium to said front end. At least one peripheral flushing hole of said at least one flushing hole opening at said front end opens in said substantially circumferential ring. At least two peripheral flushing holes open in said substantially circumferential ring.

17 Claims, 4 Drawing Sheets

(51) Int. Cl.
*E21B 4/08* (2006.01)
*E21B 4/14* (2006.01)

(56) References Cited

U.S. PATENT DOCUMENTS

| | | | | | |
|---|---|---|---|---|---|
| 3,357,507 | A | * | 12/1967 | Stewart | 175/426 |
| 3,997,011 | A | | 12/1976 | Staroba | |
| 4,598,779 | A | | 7/1986 | Liljekvist et al. | |
| 4,819,746 | A | | 4/1989 | Brown et al. | |
| 4,883,136 | A | * | 11/1989 | Trujillo | 175/339 |
| 5,025,875 | A | | 6/1991 | Witt | |
| 5,407,021 | A | * | 4/1995 | Kane et al. | 175/296 |
| 6,371,223 | B2 | * | 4/2002 | Wentworth et al. | 175/296 |
| 6,550,554 | B2 | * | 4/2003 | Gien | 175/296 |
| 6,767,156 | B1 | | 7/2004 | Larsson | |
| 7,467,675 | B2 | * | 12/2008 | Lay | 175/296 |
| 2001/0018990 | A1 | | 9/2001 | Asberg et al. | |
| 2002/0153174 | A1 | | 10/2002 | Linden et al. | |
| 2004/0069540 | A1 | * | 4/2004 | Kriesels et al. | 175/393 |
| 2007/0007045 | A1 | * | 1/2007 | Lorger et al. | 175/296 |
| 2010/0025114 | A1 | | 2/2010 | Brady | |
| 2011/0141852 | A1 | * | 6/2011 | Camwell et al. | 367/82 |
| 2012/0325558 | A1 | * | 12/2012 | Lundberg et al. | 175/57 |

FOREIGN PATENT DOCUMENTS

| | | |
|---|---|---|
| WO | 2004/003334 | 1/2004 |
| WO | 2005/010317 | 2/2005 |
| WO | WO 2007/082997 | 7/2007 |

OTHER PUBLICATIONS

Patent Examination Report No. 1, for Australian Patent Application No. 2011224885 dated May 19, 2014.

European Office Action for Application No. 10155920.1 dated Nov. 2, 2011.

European Search Report for Application No. 10155920.1 dated Jul. 26, 2010.

Office Action (with English Translation) in Russian Application No. 2012142827, dated Nov. 12, 2014.

* cited by examiner

ROCK DRILL BIT, A DRILLING ASSEMBLY AND A METHOD FOR PERCUSSIVE ROCK DRILLING

RELATED APPLICATIONS

The present application is a U.S. National Phase Application of International Application No. PCT/SE2011/050169 (filed 16 Feb. 2011) which claims priority to European Application No. 10155920.1 (filed 9 Mar. 2010).

TECHNICAL FIELD OF THE INVENTION AND BACKGROUND ART

The present invention relates to a rock drill bit for percussive drilling comprising a bit head configured to be attached at an end of a drill element of a drilling assembly and having a diameter larger than that of a said drill element, said bit head having at a front end as seen in the intended drilling direction a generally frusto-conical shape defined by a substantially circumferential ring provided with a plurality of gauge buttons distributed along the extension of the ring for engaging material to be crushed, a central flush channel extending through the bit head and having at least one flushing hole opening at said front end, at least one peripheral flushing hole of said at least one flushing hole opening at said front end opens in said substantially circumferential ring, as well as a drilling assembly and a method of percussive rock drilling according to the preambles of the corresponding appended claims.

The invention is not restricted to any type of drilling assembly for use of a said rock drill bit, but the former may be a down-the-hole hammer drill just as well as a top hammer drill.

Furthermore, said rock drill bit may have any conceivable size and has normally a diameter of 30 mm-300 mm. The same absence of limitations applies to the intended percussion frequency and rotational speed of the rock drill bit in operation, although it may be mentioned that these are typically within the ranges 20 Hz-500 Hz and 20-500 revolutions per minute, respectively.

FIG. 1 illustrates a known so-called standard rock drill bit 1 of the type defined in the introduction. The drill bit has a bit head 2 configured to be attached at an end of a drill element, for example in the form of a drill tube or drill rod, of a drilling assembly and having a diameter larger than that of a said drill element. This drill element is not shown in the figure but may be intended to be received in a so-called skirt 3 integral with the bit head and having a smaller diameter than the bit head. Other ways of connecting the drill bit to the drill element are conceivable and known within the art. The bit head has at a front end 4 as seen in the intended drilling direction a generally frusto-conical shape by having a cross-section tapering towards said front by the presence of a substantially circumferential ring 5 provided with a plurality of gauge buttons 6 distributed along the extension of the ring for engaging material to be crushed. These gauge buttons are made of hard material, such as cemented carbide. Front buttons 7 also of hard material are arranged on a front surface 8 for engaging material to be crushed.

Furthermore, the rock drill bit also has a central flush channel extending through the bit head and opening at the front by a flushing hole 9 in the front surface. The flushing medium used will typically be compressed air when drilling is carried out "above earth" and a liquid, such as water, when drilling is carried out with a drilling assembly positioned under ground.

In operation the gauge buttons 6 will engage and break rock close to the walls of a hole in which the rock drill bit with said rod is located and the front buttons 7 will break rock closer to the centre of such a hole by impacts carried out by the rock drill bit in the direction of the arrow A. The drill bit will rotate somewhat, typically about 5°, between each such impact. Cuttings resulting from said rock breaking action of the buttons 6, 7 are to be removed for enabling the buttons to efficiently break new rock during the following impact. This is achieved by the flushing medium emerging from the flushing hole 9 and flushing said cuttings away while escaping rearwardly opposite to the drilling direction A through recesses 10 in the circumference of the bit head and along the skirt 3 and said drill element having a smaller diameter than the bit head and by that than the hole drilled. The cuttings are flushed externally, outside of the drill bit.

The operation efficiency of a rock drill bit of this type is of course an important feature and this may be expressed as the penetration rate of the rock drill bit defined as the length of a hole drilled per time unit (meter/minute). The penetration rate may depend upon the wear of said buttons and the efficiency of the flushing. It is of course an ongoing attempt to increase the penetration rate of a rock drill bit of the type defined in the introduction.

WO 2005/010317 A1 relates to a reverse-circulation down hole face sampling hammer drill, wherein directing of a proportion of the exhaust air up the sample recovery bore tends to reduce the air pressure and volume of flow at the cutting face, reducing bore hole scouring. WO 2004/003334 A1 shows a drill bit provided with a plurality of flush channels. U.S. Pat. No. 6,767,156 B1 discloses a drill bit having a plurality of flush channels. U.S. Pat. No. 4,819,746 A shows a reverse circulation down-the-hole hammer bit. U.S. Pat. No. 3,997,011 A, on which the preamble of claim 1 is based, discloses a rock bit having a plurality of flush channels.

SUMMARY OF THE INVENTION

The object of the present invention is to provide a rock drill bit of the type defined in the introduction being designed to enable an increase of the penetration rate thereof with respect to such rock drill bits already known.

This object is according to the invention obtained by providing such a rock drill bit in which the flush channel has at least two peripheral flushing holes opening in said substantially circumferential ring.

By this new measure to place at least two peripheral flushing holes in said substantially circumferential ring flushing of gauge buttons of the rock drill bit may be improved, and it has turned out that this has an important positive influence upon the penetration rate of such a rock drill bit. The explanation to this is that more force is required to break rock close to the walls of a hole drilled than at the centre thereof, so that it is especially important that the gauge buttons are properly flushed and by that will engage solid rock and not cuttings during an impact. This flushing hole may efficiently remove cuttings created by gauge buttons hitting the solid rock from the hole wall region to be hit by a gauge button during the next impact. It has in fact turned out that the increase of penetration rate of a rock drill bit according to the present invention is particularly remarkable when the gauge buttons have been exerted to wear, so that it may be drilled surprisingly efficiently by such a rock drill bit even if it is noticeably worn.

According to an embodiment of the present invention at least three peripheral flushing holes open in said substantially circumferential ring to optimize flushing.

According to an embodiment of the present invention at least four peripheral flushing holes open in said substantially circumferential ring to further optimize flushing.

According to an embodiment of the present invention at least one flushing hole opens solely in said circumferential ring to further optimize flushing. This means that the rim of the at least one flushing hole only intersects the circumferential ring.

According to an embodiment of the present invention said flush channel comprises a flush channel portion ending in said at least two peripheral flushing holes and directed so as to, by a jet of flushing medium out from said hole, hit a spot on said material to be engaged by a gauge button during the next impact of the drill bit. Such a positioning and directing of said flushing hole enables said gauge button to hit solid rock during the next impact resulting in a high penetration rate of the rock drill bit. The path followed by the gauge button when rotating between two consecutive impacts will by this also be flushed clean, so that no cuttings will be moved by the gauge button to the spot for the next impact. According to another embodiment of the invention each said at least two peripheral flushing holes opens in the substantially circumferential ring at a location in front of a said gauge button as seen in the intended direction of rotation of the drill bit. This location of the flushing hole makes it easy to obtain an efficient flushing of the spot on said material to be engaged by said gauge button during the next impact of the drill bit.

According to another embodiment of the invention said location of the opening of each peripheral flushing hole has a distance to said gauge button located next therebehind as seen in said intended direction of rotation of the drill bit of 10-50% or 10-30% of the distance of said gauge button to the next consecutive gauge button in front thereof in said direction of rotation.

According to another embodiment of the invention said flush channel comprises a flush channel portion ending in each peripheral flushing hole and configured to create a jet of flushing medium out from said ring in a direction making the same angle ±10°, such as 90°, to the surface of the substantially circumferential ring as made by an extension of a said gauge button to said surface. Such a direction of said flush channel portion and by that said jet of flushing medium will result in an efficient clean-flushing of a material spot to be hit by said gauge button.

According to another embodiment of the invention the flush channel has at least as many flushing holes as the drill bit has gauge buttons, and each gauge button is associated with a flushing hole with a flush channel portion ending therein and directed to, by a jet of flushing medium, hit a spot on said material to be engaged by a said gauge button during the next impact of the drill bit. This means that all the gauge buttons of the rock drill bit will at each impact hit substantially only solid rock resulting in a high penetration rate of the rock drill bit.

According to another embodiment of the invention said bit head has a front surface surrounded by said substantially circumferential ring and provided with a plurality of front buttons configured to engage material to be crushed, and said flush channel has at least two flushing holes opening in said front surface. Efficient flushing of such front buttons may by this be obtained and this is also beneficial to the penetration rate of the rock drill bit.

According to another embodiment of the invention said flush channel has at least one flushing hole opening in said front surface and associated with a said gauge button with a flush channel portion ending therein and directed to, by a jet of flushing medium, hit a spot to be engaged by said gauge button during the next impact of the drill bit. Such an arrangement of at least one flushing hole will result in an improved flushing of front buttons at the same time as it ensures proper flushing of the gauge button associated therewith.

According to another embodiment of the invention said front surface flushing hole associated with a said gauge button is located at a distance to said ring of at least 10% of the radius of a circle defined by an inner border of said ring. This results in a direction of a flushing medium from said hole promoting a flow of flushing medium from peripheral flushing holes opening in said substantially circumferential ring across the front of the rock drill bit for also flushing front buttons thereof.

According to another embodiment of the invention all said gauge buttons except one has a said flushing hole opening in said substantially circumferential ring associated therewith and one said gauge button has a said flushing hole opening in said front surface associated therewith. This results in a very efficient flushing of all gauge buttons and also front buttons of the rock drill bit.

According to another embodiment of the invention each said peripheral flushing hole has a cross-sectional area that is less than a cross-sectional area of a base of a said gauge button.

According to another embodiment of the invention each said peripheral flushing hole has a cross-sectional area of less than 50%, such as 5%-40% or 10%-30% of a cross-sectional area of a base of a said gauge button.

The invention also relates to a drilling assembly for percussive rock drilling and a method of percussive rock drilling according to the appended independent claims for such an assembly and method. Such a drilling assembly and method of percussive rock drilling makes it possible to carry out rock drilling with an increased penetration rate with respect to such drilling assemblies and methods utilizing known rock drill bits.

The invention also relates to a use of a rock drill bit according to the invention for percussive rock drilling into earth material, such as rock.

Further advantages as well as advantageous features of the invention will appear from the following description.

BRIEF DESCRIPTION OF THE DRAWINGS

With reference to the appended drawings, below follows a specific description of embodiments of the invention cited as examples.

In the drawings.

DETAILED DESCRIPTION OF EMBODIMENTS OF THE INVENTION

Figures 1, 2, 3, 4, 5:
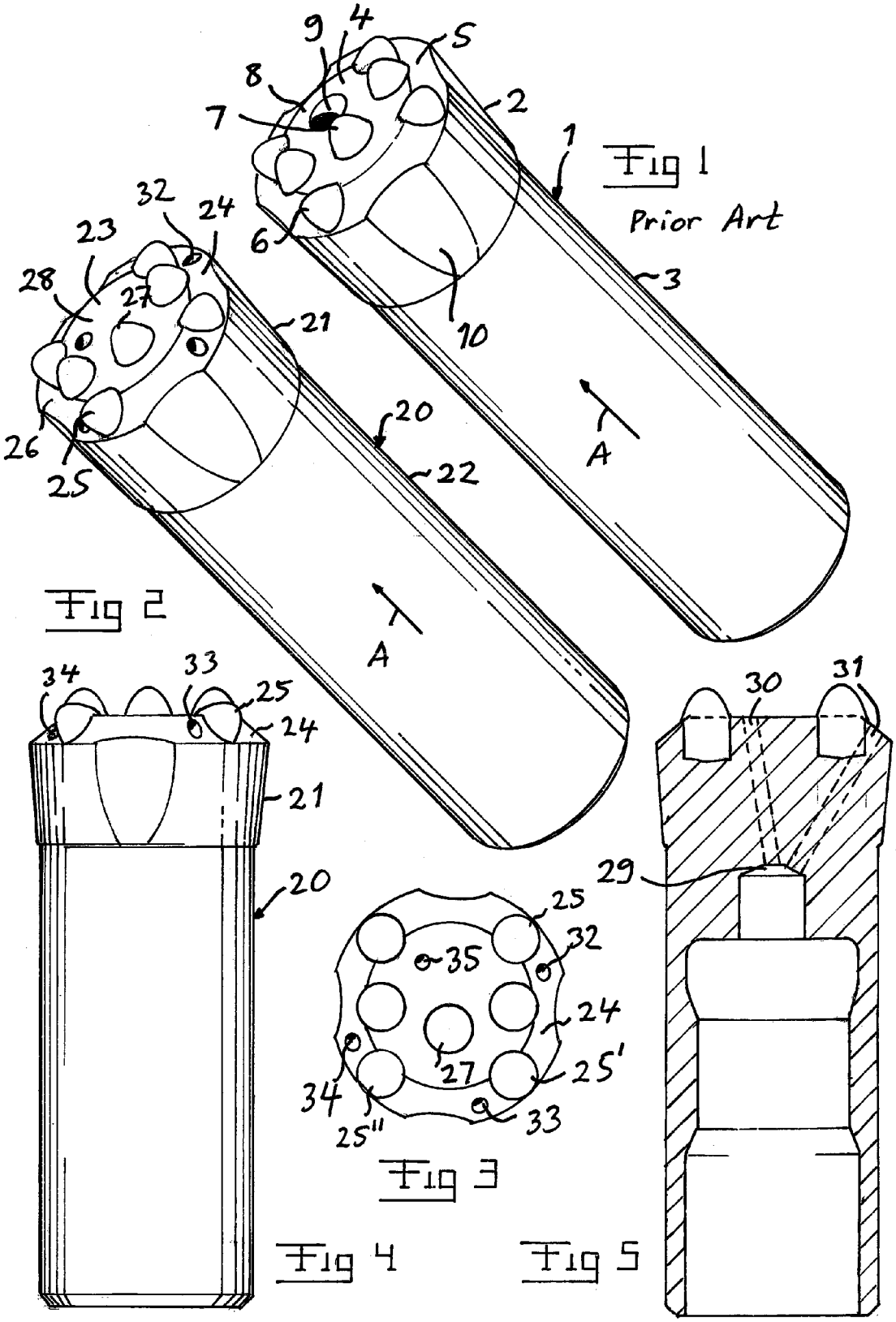
Fig 1 Prior Art
FIG. 1 is a perspective view of a rock drill bit according to the prior art.
FIG. 2 is a view corresponding to FIG. 1 of a rock drill bit according to a first embodiment of the invention.
FIG. 3 is a front end view of the rock drill bit according to FIG. 2.
FIG. 4 is a side elevation view of the rock drill bit according to FIG. 2.
FIG. 5 shows a longitudinal section through the rock drill bit according to FIG. 2.

A rock drill bit 20 according to a first embodiment of the present invention will now be described while making reference to FIG. 2-5. This rock drill bit differs from the known rock drill bit shown in FIG. 1 and described above only with respect to the end of the flushing channel and the arrangement of flushing holes. Accordingly, the rock drill bit has a bit head 21 configured to be attached at one end of a drill element of a drilling assembly by being integral with a skirt 22 which may by designed to internally receive a said drill element. Any other way of attaching the drill element with respect to the drill bit is possible. The bit head has a diameter being larger than that of said skirt 22 and accordingly also of a said drill element. The bit head has at a front end 23 as seen in the intended drilling direction (arrow A) a generally frusto-conical shape defined by a substantially circumferential circular ring 24 provided with four gauge buttons 25 of hard material, such as sintered cemented carbide, uniformly distributed along the extension of the ring and extending substantially perpendicularly to the surface 26 of the ring. Three front buttons 27 of hard metal are arranged on a front surface 28 surrounded by said ring. A central flush channel 29 comprises four flush portions 30, 31 (see FIG. 5) ending in a flushing hole 32-35 each. The flushing holes 32-34 opening in the circumferential ring 24 is here called peripheral flushing holes. Three of the peripheral flushing holes 32-34 open in said circumferential ring 24, and one flushing hole 35 opens in said front surface 28. The cross-sectional area of each flushing hole 32-35 may be, but does not have to be, less than the cross-sectional area of the flushing hole in a corresponding rock drill bit of the type shown in FIG. 1. Preferably, at least two peripheral flushing holes 32-34 open solely in said circumferential ring 24 to optimize flushing.

Each gauge button 25 is associated with a flushing hole 32-35 with a flush channel portion ending therein and directed to, by a jet of flushing medium, hit a spot on said material to be engaged by a said gauge button during the next impact of the drill bit. The three peripheral flushing holes 32-34 arranged in said substantially circumferential ring 24 are arranged at a location in front of the gauge button 25, 25' and 25" associated therewith as seen in the intended direction of rotation of the drill bit.

Figure 13:
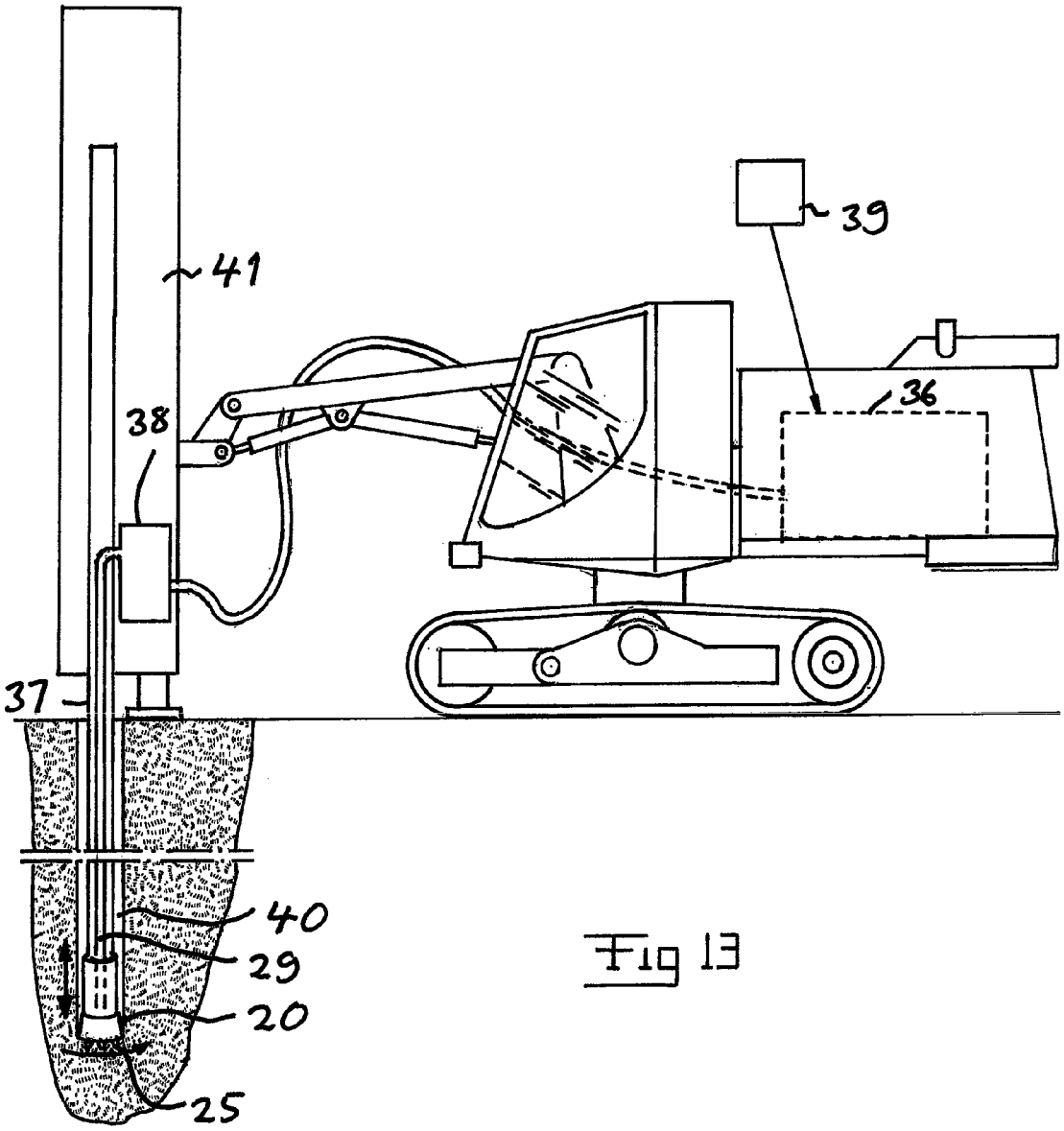
FIG. 13 is a very simplified view of a drilling assembly for percussive rock drilling according to an embodiment of the present invention in operation.

The function of a rock drill bit according to this embodiment of the invention will now be explained while also making reference to FIG. 13, which very schematically illustrates a drilling assembly for percussive rock drilling according to the present invention. This drilling assembly is a so-called top hammer drill acting upon the rock drill bit from a location above the ground and has power means 36, such as an hydraulic motor, configured to act upon a said drill element 37 and by that the rock drill bit (see also FIG. 5) so as to make the latter rotate and carry out percussions for engaging material to be crushed. A design of the drilling assembly as a down-the-hole drill is also within the scope of the present invention.

The drilling assembly has also means 38, such as a compressed air generator, configured to flush cuttings resulted from engagement of the gauge buttons and the front buttons of the drill bit away from the region occupied by the drill bit. The drilling assembly has a control arrangement 39 configured to control the operation of the power means 36 so as to adapt the frequency of impacts and the rotational speed of the drill bit so as to hit a spot on material to be engaged by a said gauge button during the next impact of the drill bit by a jet of flushing medium from the flushing holes 32-35. This embodiment also includes the case of having power means configured to drive a said drill element 37 with a predetermined constant frequency of impacts and rotational speed, in which said adaption has been obtained by considering this when designing the rock drill bit with respect to the location of the flushing holes and the direction of the flush channel portions ending therein.

The jets of flushing medium from the flushing holes 32-35 will clean the wall portions of a hole 40 drilled in the ground to be hit by the respective gauge button during the next impact, so that the gauge buttons will substantially only hit solid rock and by that break rock more efficiently than would cuttings still be present where the gauge buttons hit. The location of one 35 of the flushing holes in the front surface will result in a direction of a jet of flushing medium therefrom away from the centre of the rock drill bit as seen in FIG. 3, which counteracts stagnation of flushing medium in said centre from the three peripheral flushing holes, where the front buttons 27 are located, so that these are also properly flushed.

Comparative experiments were carried out for a known standard rock drill bit A according to FIG. 1 and a rock drill bit B of the invention according to FIG. 2 for examining the influence of the change in flushing upon the penetration rate. The rock drill bits tested had a bit end diameter of 45 mm, four gauge buttons with a base diameter of 10 mm and three front buttons with a base diameter of 9 mm. The rock drill bits had a skirt diameter of 39 mm.

The rock drill bits were drilled in a new face in a test mine. The drilling assembly was warmed up by drilling a used bit for approximately five minutes prior to the tests. A hexagonal rod 37 was fitted in the drifter 41, which allowed for 4.1 meter holes to be drilled. During drilling of each hole the average penetration rate was noted, along with possible other information, such as if the bit got stuck during drilling.

Every five holes the drill bits were photographed with a digital camera and each button was pictured using a small USB microscope connected to a laptop. The drill bits were drilled for 25 holes, where penetration rate typically had gone below 3 meters/minute.

To measure the wear on the buttons, the microscope images were read into an image processing software. The wear was then measured by manually measuring the shortest distance of the wear flat ellipse.

Figure 6:
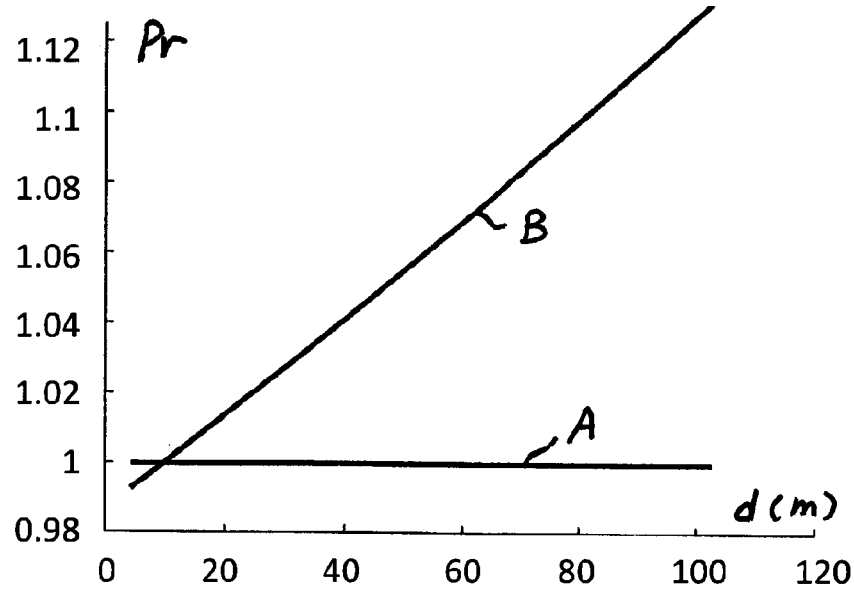
FIG. 6 is a graph of the penetration rate versus distance drilled relative to a known rock drill bit according to FIG. 1 and a rock drill bit of the invention according to FIG. 2.
Figure 7:
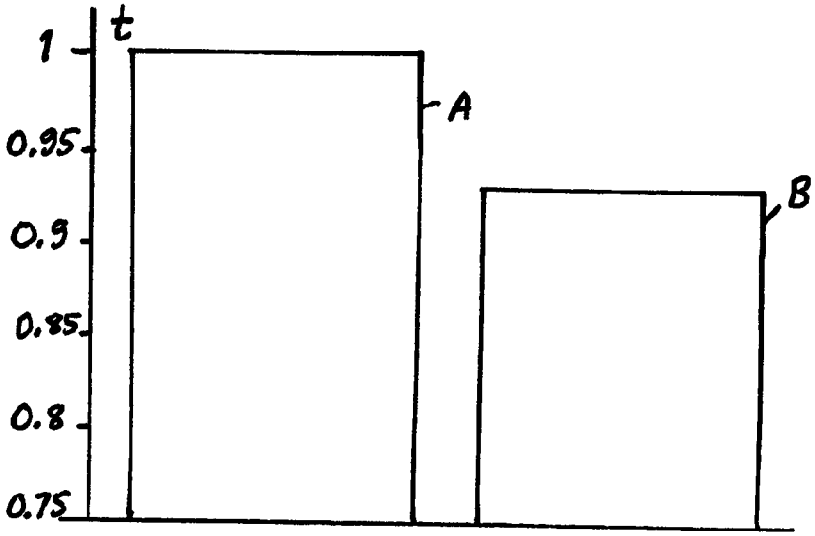
FIG. 7 is a graph showing the time to drill 25 holes relative to a known rock drill bit according to FIG. 1 and a rock drill bit of the invention according to FIG. 2.
Figure 8:
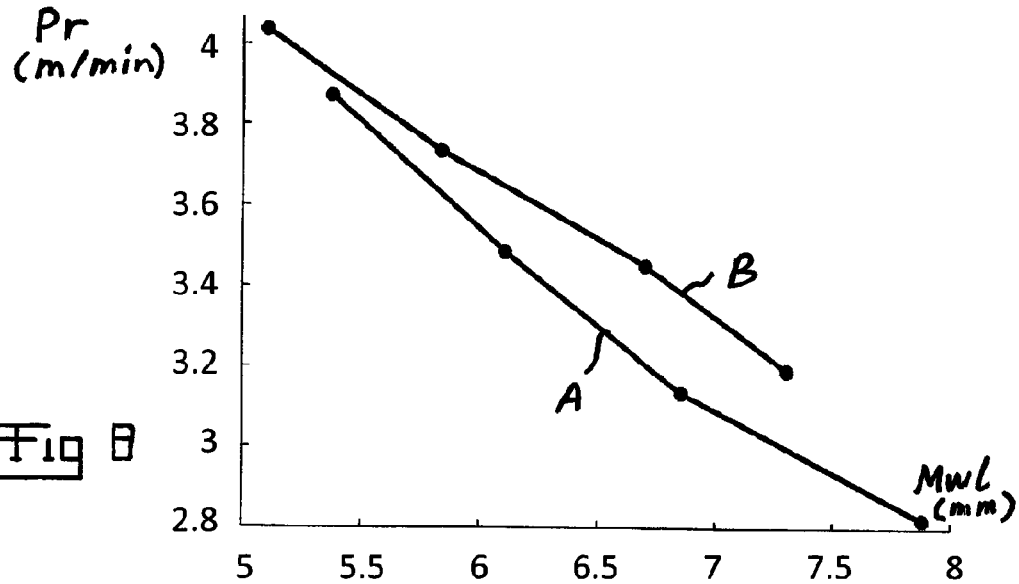
FIG. 8 is a graph of penetration rate versus mean wear length per gauge button of known rock drill bits according to FIG. 1 and rock drill bits of the invention according to FIG. 2.

FIG. 6-8 show results of the tests, in which FIG. 6 illustrates the penetration rate in meter drilled per minute relative to the standard bit A according to FIG. 1 versus the distance drilled for the rock drill bits A and B. It appears that the penetration rate Pr of the rock drill bit B according to the present invention relative to the standard drill bit A increases with the distance drilled d, which means that it drills progressively faster than the standard bit as the buttons and bit wear down.

FIG. 7 illustrates the time t to drill 25 holes relative to the standard bit A.

FIG. 8 illustrates the penetration rate in meter/minute versus the mean wear length Mwl per gauge button, from which it appears that the standard bit according to FIG. 1 has a lower penetration rate for a specific wear than the rock drill bit of the invention according to FIG. 2.

The appearance of the above results may be explained as follows. Simulations show that a standard drill bit according to FIG. 1 is likely to have poorer flushing than the drill bit of the invention according to FIG. 2, meaning that the buttons would travel in larger amount of rock cuttings than the drill bit according to FIG. 2. Less interaction with solid rock will slow the penetration rate. The better flushing of the gauge buttons of the drill bit according to FIG. 2 will increase the contact with solid rock and thus lead to faster penetration rate.

Thus, the results indicate that improved flushing and bit design could increase penetration rate in the order of 10%, and the results show that the bit with the newer flushing design according to FIG. 2 can drill faster for a certain wear than standard bits according to FIG. 1.

The most important result of the new flushing hole configuration according to the present invention seems to be that it gets possible to drill faster with worn buttons of such a drill bit than a known standard drill bit.

Some of many possible modifications of the flushing hole design of drill bits within the scope of the present invention are shown in FIG. 9-12. The rock drill bit according to FIG. 9 has two said peripheral flushing holes 32', 33' associated with two consecutive gauge buttons 25, 25', which results in an engagement of solid rock of these gauge buttons in each impact at the same time as the front buttons 27 will be satisfyingly flushed by the fact that flushing medium flowing towards the centre will not be counteracted by flushing medium flowing in the opposite direction.

Figure 10:
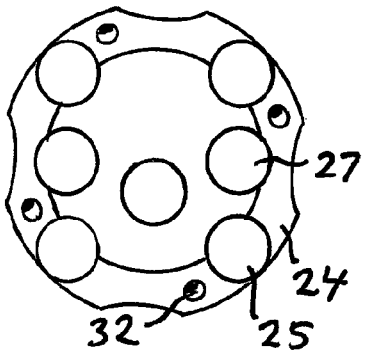

FIG. 10 shows how each gauge button has a flushing hole arranged in the substantially circumferential ring associated therewith for proper flushing of the material spot to be hit by the gauge button during the next impact.

Figure 9:
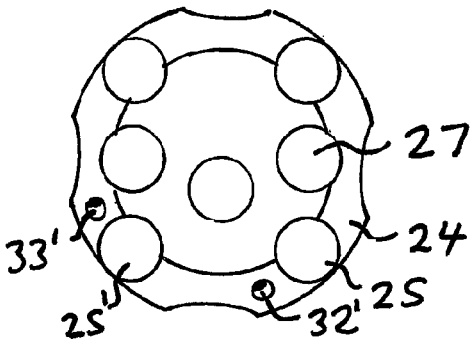
FIG. 9-12 are front end views of rock drill bits according to further embodiments of the present invention.
Figure 11:
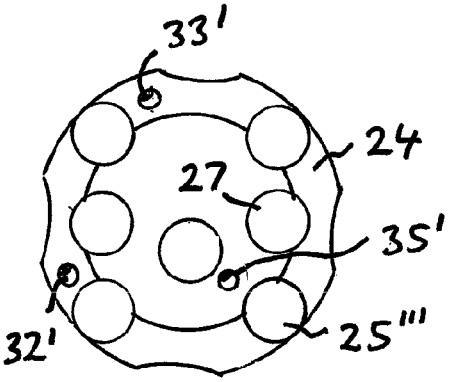

FIG. 11 shows a flushing hole design corresponding to that of FIG. 9 with a front surface flushing hole 35' associated with a gauge button 25".

Figure 12:
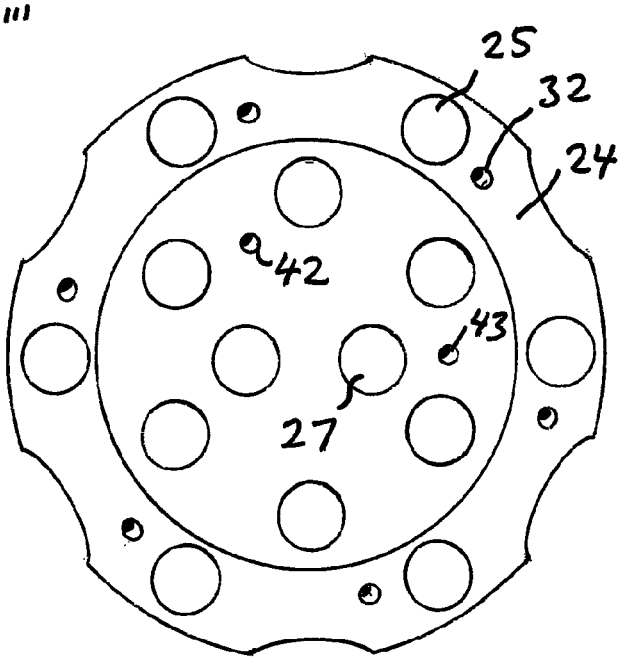

Finally, FIG. 12 illustrates a typical appearance of a rock drill bit having a larger diameter and by that a larger number of buttons, here six gauge buttons and eight front buttons. Each gauge button has a circumferential ring flushing hole associated therewith, and two flushing holes 42, 43 are arranged in the front surface with a main object to remove cuttings resulting from the engagement of the front buttons with rock.

The invention is of course not in any way restricted to the embodiments described above, but many possibilities to modifications thereof would be apparent to a person with skill in the art without departing from the scope of the invention as defined in the appended claims.

The invention can be applied to a drill bit for a down-the-hole hammer. A down-the-hole hammer typically includes an outer cylindrical casing connectable to a rotatable drill pipe string, through which compressed air is conducted. A hammer piston reciprocates in the cylindrical casing, and compressed air is directed alternately to the upper and lower ends of the piston to effect its reciprocation in the casing, each downward stroke inflicting an impact blow upon an anvil of the drill bit extending upwardly within the lower portion of the cylindrical casing. The piston and drill bit include passageways for the pressurized air.

The number and position of the buttons of the rock drill bit may differ a lot with respect to the embodiments shown in the figures. The recesses for back flow of cuttings may have different shapes, and the bit head may also be provided with a channel for removal of cuttings and flushing medium. These are only a few examples of possible modifications.

"Generally" and "substantially" are used in the expression "generally frusto-conical shape by a substantially circumferential ring" for also covering the case when cuttings recesses or grooves and/or gauge buttons cut off the ring, as shown in the Figures.

The disclosures in European patent application No. 10155920.1, from which this application claims priority, are incorporated herein by reference.

The invention claimed is:

1. A rock drill bit for percussive drilling comprising:

a bit head configured to be attached at an end of a drill element of a drilling assembly and having a diameter larger than that of a said drill element, wherein said bit head has, at a front end relative to an intended drilling direction, a generally frusto-conical shape defined by a substantially circumferential ring, wherein said bit head includes:

a plurality of gauge buttons distributed along an extension of the ring, and a central flush channel extending through the bit head and having at least three flushing holes that each open at said front end to conduct flushing medium to said front end, and wherein one of the at least three flushing holes is a face flushing hole that opens at a front surface of the bit head and two of the at least three flushing holes are peripheral flushing holes that open in said substantially circumferential ring, and wherein said bit head has a circumferential surface and further includes a plurality of recesses in the circumferential surface through which flushing media is conducted rearwardly, externally of the rock drill bit.

2. A rock drill bit according to claim 1, wherein the bit head includes at least three peripheral flushing holes that open in said substantially circumferential ring.

3. A rock drill bit according to claim 1 wherein the bit head includes at least four peripheral flushing holes that open in said substantially circumferential ring.

4. A rock drill bit according to claim 1, wherein at least one of the peripheral flushing holes opens solely in said circumferential ring.

5. A rock drill bit according to claim 1, wherein said flush channel comprises a flush channel portion ending in said peripheral flushing hole and directed so as to, by a jet of flushing medium out from said hole, hit a spot on a material to be crushed by an associated gauge button during the next impact of the drill bit.

6. A rock drill bit according to claim 1, wherein each of said peripheral flushing holes opens in the substantially circumferential ring at a location in front of an associated gauge button as seen in an intended direction of rotation of the drill bit.

7. A rock drill bit according to claim 6, wherein said location of the opening of each peripheral flushing hole has a distance to said associated gauge button located next therebehind, as seen in said intended direction of rotation of the drill bit, of 10-30% of a distance of said associated gauge button to a next consecutive gauge button at a position that is in front thereof in said direction of rotation.

8. A rock drill bit according to claim 6, wherein said location of the opening of each peripheral flushing hole has a distance to said associated gauge button located next therebehind, as seen in said intended direction of rotation of the drill bit, of 10-50% of a distance of said associated gauge button to a next consecutive gauge button at a position that is in front thereof in said direction of rotation.

9. A rock drill bit according to claim 1, wherein said central flush channel comprises a flush channel portion ending in each flushing hole and configured to create a jet of flushing medium extending out from said ring in a direction making a first angle to a surface of the substantially circumferential ring, wherein an extension of said associated gauge button makes a second angle to said surface, and wherein the first angle and the second angle are the same ±10°.

10. A rock drill bit according to claim 1, wherein the flush channel has at least as many flushing holes as the drill bit has gauge buttons, and wherein each gauge button is associated with a flushing hole with a flush channel portion ending therein and directed to, by a jet of flushing medium, hit a spot on a material to be crushed by said associated gauge button during the next impact of the drill bit.

11. A rock drill bit according to claim 1, wherein said bit head has a front surface surrounded by said substantially circumferential ring and provided with a plurality of front buttons configured to engage material to be crushed, wherein said flush channel comprises a flush channel portion ending in said face flushing hole, and directed so as to, by a jet of flushing medium out from said face flushing hole, hit a spot on said material to be crushed by an associated front button during the next impact of the drill bit.

12. A rock drill bit according to claim 11, wherein said face flushing hole is located at a distance to said circumferential ring of at least 10% of a radius of a circle defined by an inner border of said ring.

13. A rock drill bit according to claim 1, wherein each of said peripheral flushing holes has a cross-sectional area that is less than a cross-sectional area of a base of an associated gauge button.

14. A rock drill bit according to claim 1, wherein each of said peripheral flushing holes has a cross-sectional area of less than 50% of a cross-sectional area of a base of an associated gauge button.

15. A drilling assembly for percussive rock drilling comprising:

a rock drill bit;

power means configured to act upon said rock drill bit to make the rock drill bit rotate and carry out impacts for engaging material to be crushed;

means configured to flush cuttings resulted from said engagement away from a region occupied by the drill bit; and a control arrangement configured to control operation of said power means, wherein said rock drill bit is a rock drill bit according to claim 1, and wherein said control arrangement is configured to control said power means to adapt a frequency of impacts and a rotational speed of the drill bit so a jet of flushing medium from each of said two peripheral flushing holes hits a spot on the material to be crushed by said associated gauge button during a next impact of the drill bit.

16. A method of percussive drilling, the method comprising percussively engaging earth material with the rock drill bit according to claim 1 and rotating the rock drill bit.

17. A method of percussive rock drilling, comprising:

controlling power means of a drilling assembly provided with a rock drill bit according to claim 1 to adapt a frequency of impacts and a rotational speed of the drill bit so a jet of flushing medium from each of said two peripheral flushing holes hits a spot on a material to be crushed by one of said gauge buttons during a next impact of the drill bit.

* * * * *